United States Patent [19]

Schwartz et al.

[11] Patent Number: 4,888,749

[45] Date of Patent: Dec. 19, 1989

[54] THREE HAND MOVEMENT FOR A TIMEPIECE HAVING A STEPPING MOTOR

[75] Inventors: Herbert Schwartz, Wurmberg, Fed. Rep. of Germany; Paul Wuthrich, Watertown, Conn.

[73] Assignee: Timex Corporation, Middlebury, Conn.

[21] Appl. No.: 303,413

[22] Filed: Jan. 30, 1989

[51] Int. Cl.[4] ..... G04F 5/00

[52] U.S. Cl. ..... 368/157; 368/160

[58] Field of Search ..... 368/156, 160, 76, 157, 368/322; 310/49 R, 40 MM

[56] References Cited

U.S. PATENT DOCUMENTS

| | | | |
|---|---|---|---|
| 4,426,158 | 1/1984 | Muller et al. | 368/157 |
| 4,483,627 | 11/1984 | Muller et al. | 368/157 |
| 4,647,218 | 3/1987 | Wuthrich | 368/157 |

*Primary Examiner*—Bernard Roskoski

*Attorney, Agent, or Firm*—William C. Crutcher

[57] ABSTRACT

An improved movement for a three hand quartz analog timepiece having a frame, a stepping motor with the motor pinion adapted to step once per second, and a plurality of coaxial output members rotatably mounted in the frame including a spindle for driving a "seconds" hand and having a toothed seconds wheel driven by a two-pin rotor pinion, a two-pin reduction drive pinion connected to the spindle, a coaxial sleeve having a toothed minutes wheel and a coaxial sleeves having a toothed hours wheel. The improvement comprises a dual reduction gear assembly with a single shaft rotatably mounted in the frame having a toothed third wheel driven by the reduction drive pinion and having a first reduction pinion and a second reduction pinion directly driving the hours and minutes wheel, respectively, from the same shaft. The first reduction pinion is the two-pin type and the second reduction pinion is a spur gear.

6 Claims, 2 Drawing Sheets

THREE HAND MOVEMENT FOR A TIMEPIECE HAVING A STEPPING MOTOR

BACKGROUND OF THE INVENTION

This invention relates generally to a movement for a timepiece with a stepping motor and more particularly relates to a three hand low cost movement for a quartz analog wristwatch.

Quartz analog wristwatches are known which have a Lavet-type stepping motor energized by periodic current pulses provided by an integrated circuit, which is energized by a button-type energy cell contained in the timepiece movement. The stepping motor, which is most commonly in use, has a stator including a core and a winding connected to receive the current Pulses which alternate in polarity. The rotor of the stepping motor most commonly has a two pole permanent magnet rotatable within an opening in the stator, so that with each pulse, the rotor steps one half a revolution. The rotor has an output gear pinion which rotates the hands of the timepiece through a suitable gear reduction train. The present invention concerns an improvement and simplification of the gear reduction train for a three hand wristwatch, i.e., having "seconds", "minutes", and "hours" hands.

A movement is described in U.S. Pat. No. 4,647,218 issued Mar. 3, 1987 to P. Wuthrich and assigned to the Applicant's assignee, wherein a stepping motor rotor with a Pinion consisting of two parallel pins equidistant from the rotor axis directly drives the "minutes" wheel of a two hand watch by stepping the rotor one half a revolution once each minute. The movement includes a wheel and pinion reduction gear rotatably mounted on a single shaft to drive the hours wheel and hours hand. However, this timepiece does not have a "seconds" hand.

A three hand wristwatch movement is disclosed in U.S. Pat. Nos. 4,426,158 issued Jan. 17, 1984 and 4,483,627 issued Nov. 20, 1984 to Muller et al., which incorporates a stepping motor rotor having a similar two-pin pinion driving a seconds wheel and seconds spindle. Coaxially disposed around a post supporting the seconds spindle from the stepping motor stator are two rotatable sleeves with connected wheels, one for the minutes and the other for the hours. A pair of wheel and pinion reduction gear assemblies are coaxially mounted to rotate with respect to one another and with respect to the stationary bearing support. One such wheel and pinion reduces the speed to drive the minutes wheel. The other wheel and pinion is driven by a pinion on the minutes spindle and reduces speed further to drive the hours wheel. This construction requires a pair of coaxially mounted reduction gear assemblies which are rotatable with respect to one another as well as with respect to the stationary bearing support.

Accordingly, one object of the present invention is to provide an improved movement for a three hand timepiece with simpler construction and fewer parts in order to reduce the cost.

Another object of the invention is to provide an improved movement for a three hand quartz analog wristwatch.

DRAWINGS

The invention, both as to organization and method of practice, together with further objects and advantages thereof, will best be understood by reference to the following specification taken in connection with the accompanying drawings, in which:

FIG. 1 is a simplified plan view of the improved movement illustrating the important features thereof in the gear train, but omitting unnecessary details, and FIG. 2 is a cross-section taken along zig-zag line II—II of FIG. 1.

SUMMARY OF THE INVENTION

The invention is an improved movement for a three hand quartz analog timepiece having a stationary member such as a frame, a stepping motor with the rotor pinion adapted to step once per second, and a plurality of coaxial output members rotatably mounted in the frame including a spindle for driving a "seconds" hand and having a toothed seconds wheel and reduction drive pinion driven by the rotor pinion, a coaxial sleeve having a toothed minutes wheel and another coaxial sleeve having a toothed hours wheel. The improvement comprises a dual reduction gear assembly with a single shaft rotatably mounted in the frame having a toothed third wheel driven by the reduction drive pinion and having a first reduction pinion and second reduction pinion directly driving the hours and minutes wheels, respectively from the same shaft. In the preferred embodiment, the rotor pinion, the reduction drive pinion, and first reduction pinion are of the two-pin type, while the second reduction pinion is an ordinary spur gear.

DESCRIPTION OF THE PREFERRED EMBODIMENT

Figure 1:
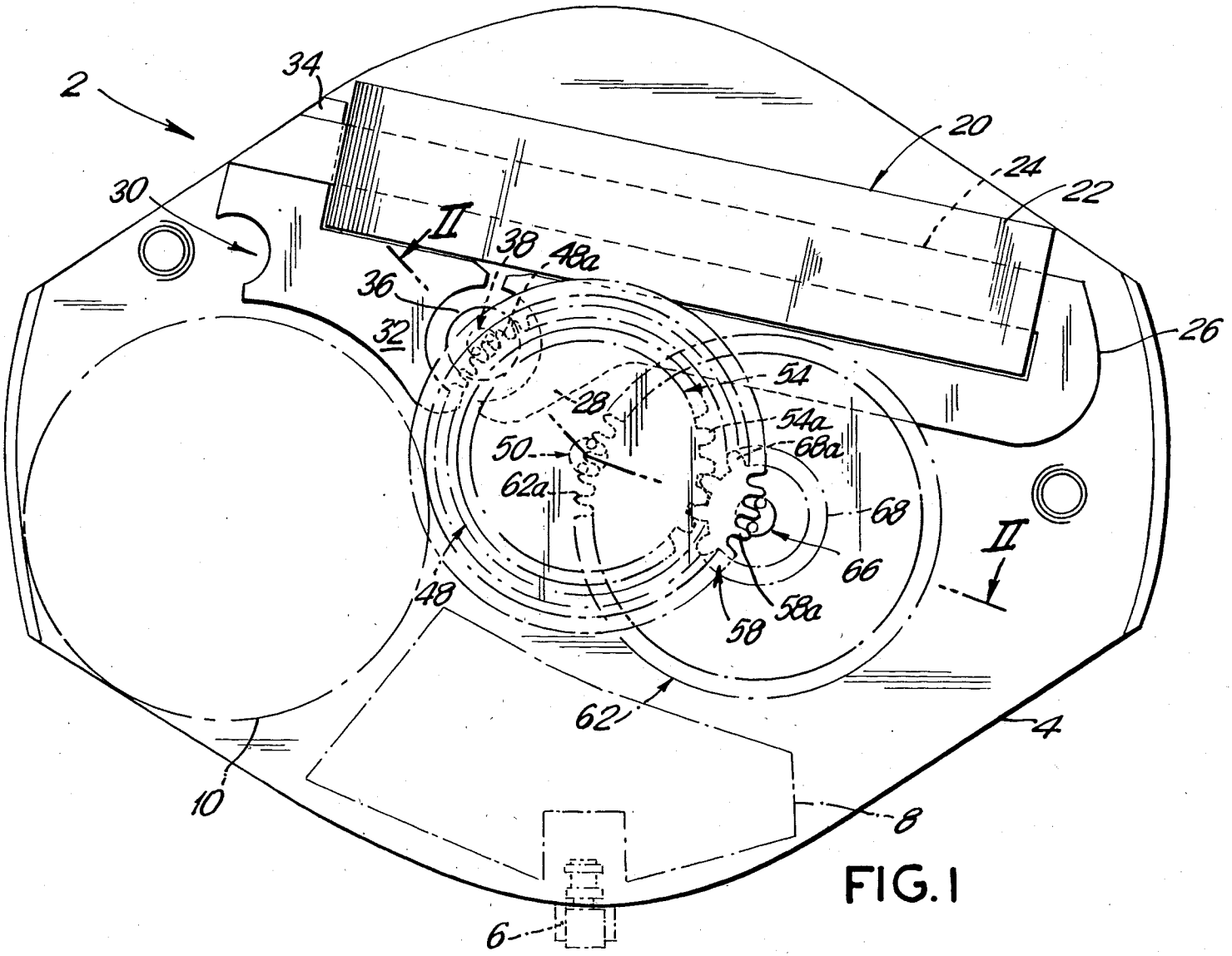

Referring to FIG. 1 of the drawing, a simplified or schematic drawing is shown of timepiece movement 2, which includes a stationary member such as a plastic frame 4 designed to fit into a timepiece case (not shown). The movement contains elements which are not material to the present invention and hence shown only in Phantom lines, such as a stem 6 for setting the position of the hands, printed circuit board 8 containing an integrated circuit, and an energy cell 10 supplying power to the integrated circuit.

Figure 2:
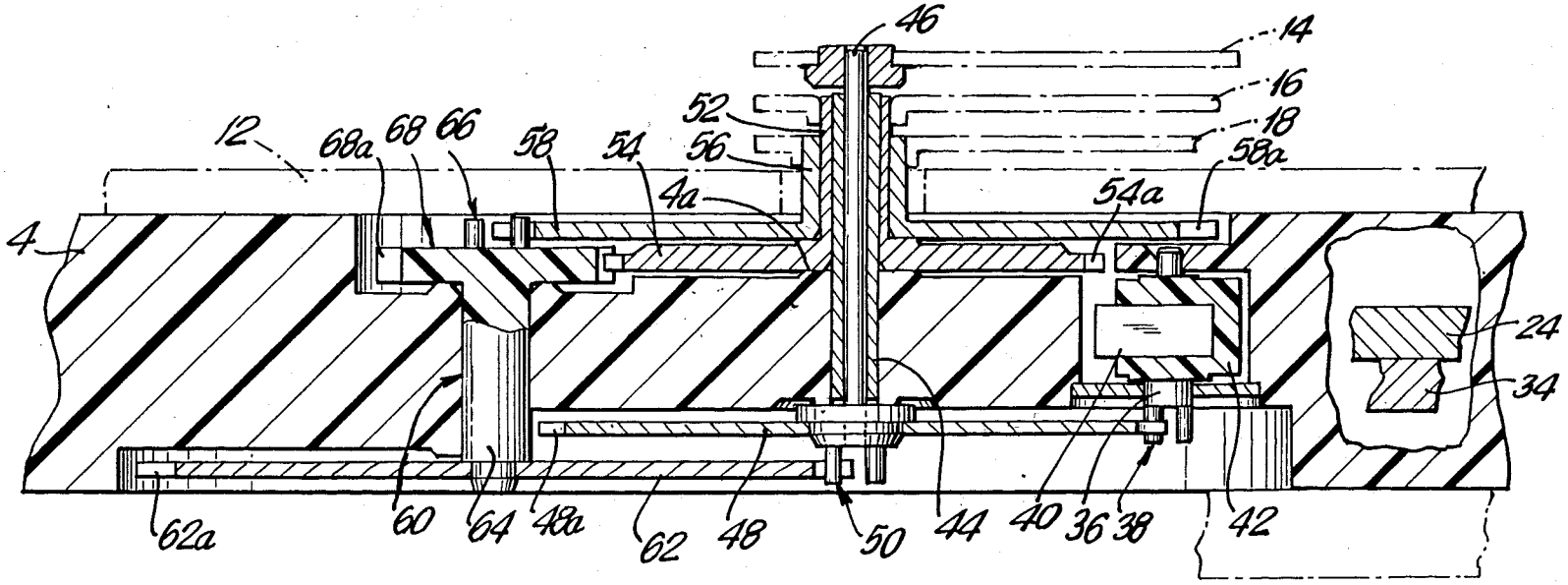

Reference to the cross-section view of FIG. 2 shows a plastic frame 4. During assembly of the timepiece, other members are added, such as a watch dial 12, "seconds" hand 14, "minutes" hand 16, and "hours" hand 18, shown in phantom line in FIG. 2, but omitted from FIG. 1.

Hands 14, 16 and 18 are driven by a stepping motor shown generally at 20, which comprises a winding coil 22 encircling a core 24. Core 24 is part of a J-shaped stator member 26 terminating in a pole shoe 28. A separate stator member 30 includes a pole shoe 32 and a short section 34 underlying and connected in magnetic circuit with the core 24. The pole shoes 28, 32 define an opening surrounding rotor 36. The rotor 36, as seen in FIG. 2, includes a two pin rotor pinion 38 and a bipolar permanent magnet 40 with a plastic overmolding portion 42. The plastic overmolding may conveniently provide the bearings for the rotor as well as the two parallel pins comprising the rotor pinion 38.

Disposed in the center of the movement frame are a plurality of coaxial output members which are carried upon a stationary hollow post 44 secured in the frame 4. One of the coaxial members is a seconds spindle 46 adapted at its upper end to receive the seconds hand 14 and having connected to its lower end a toothed seconds wheel 48 with teeth 48*a* which may either be plastic or metal and a reduction drive pinion 50, which is also of the two-pin type. The seconds wheel 48 and reduction drive pinion 50 may be separate parts connected by interference fit or may be manufactured as a single piece.

Rotatably disposed on the outside of post 44 is and coaxial with spindle 46 a minutes sleeve 52 connected to a minutes wheel 54, sometimes known in the art as a "center wheel." Wheel 54 and its sleeve 52 are preferably metal and rest upon an annular shoulder 4*a* molded into the frame to provide clearance for rotation. Wheel 54 has ordinary spur teeth 54*a* around its periphery.

Another coaxial member is an hours sleeve 56 connected to or integral with an hours wheel 58 having peripheral teeth 58*a*.

According to the present invention, a dual reduction gear assembly shown generally at 60 is rotatably mounted in frame 4 and comprises a third wheel 62 with peripheral teeth 62*a* disposed at one end of a single shaft 64. The other end of shaft 64 terminates in two separate drive pinions comprising a first reduction pinion 66 preferably consisting of a two-pin pinion meshing with hours wheel 58 and a second pinion 68 having spur teeth 68*a* meshing with those of minutes wheel 54. The upper part of the reduction gear assembly 60 is preferably plastic, having the first reduction pinion 66 and second reduction pinion 68 formed as an integral part thereof with shaft 64. The third toothed wheel 62 on the lower end of the reduction gear assembly may either be metal or plastic and is connected thereto by press fitting over an extension of the shaft 64.

The gears may best be seen in FIG. 1 of the drawing, where the meshing teeth 54*a* and 68*a* are ordinary spur gear design as commonly used in watch gearing. On the other hand, the teeth 48*a*, 62*a*, and 58*a* which are driven by the two-pin Pinions 38, 50, 66, respectively are of a special shape, the teeth having a slot of uniform width between them and the tips of the teeth being ogival in shape in order to guide the pins into the slots between teeth as the pins alternately engage in alternate slots to rotate the wheels. The latter-described type of two-pin pinion and tooth shape on the wheel provides a much larger reduction between pinion and wheel than ordinary spur teeth pinion and gear arrangements.

Thus the dual reduction gear assembly 60 which is driven directly from the seconds spindle 46 can drive both the minutes wheel and the hours wheel from two pinions on the same shaft.

A satisfactory arrangement in which the rotor steps half a revolution each second employs 60 teeth on the seconds wheel 48 to rotate the seconds hand once per minute, and 60 teeth on the reduction gear third wheel 62 to rotate it two revolutions Per hour. The spur gear reduction between second reduction Pinion 68 and minutes wheel 54 is 1:2, which may be furnished, for example, by 10 spur teeth on the pinion 68 and 20 spur teeth on the minutes wheel 54, so as to rotate the minute hand once per hour. The hour wheel 58 has 48 teeth cooperating with the two-pin first reduction pinion 66 to rotate the hour hand once every 12 hours. The pitch diameter of the spur gear Pinion 68 is greater than the pitch diameter of the two-pin Pinion 66.

Therefore, by employing two pinions on the same shaft in the reduction gear assembly, the first reduction pinion to hour wheel providing a much greater speed reduction than the second reduction pinion to minutes wheel, both the hours wheel and the minutes wheel can be driven together from the same reduction gear shaft at the proper gear ratio with respect to one another.

While the invention has been shown and described using the preferred embodiment of two-pin output pinions, it is also possible to use a single offcenter pin for the reduction drive pinion 50 and use half the number of teeth on wheel 62. It is also possible to supply drive pulses less frequently than one per second, for example, one pulse every two seconds and to correspondingly increase the size and decrease the number of teeth on wheel 48 without departing from the scope of the Present invention. While the invention is shown and described for a construction where the gear train is supported in bearings in the plastic frame, the term stationary member includes other equivalent support members, such as bridges, stepping motor stator plates, front or back plates and so forth.

While there has been described what is considered to be the preferred embodiment of the invention, other modifications will occur to those skilled in the art, and it is desired to secure in the appended claims all such modifications as fall within the true spirit and scope of the invention.

We claim:

1. An improved movement for a three hand quartz analog timepiece having a stationary member, a stepping motor with a rotor pinion adapted to periodically rotate half a revolution, and a plurality of coaxial output members rotatably mounted in said stationary member, said coaxial output members including a seconds spindle adapted to receive a "seconds" hand and having a toothed seconds wheel and a reduction drive pinion connected thereto, said seconds wheel meshing with and driven by said rotor pinion, a minutes sleeve adapted to receive a "minutes" hand and having a toothed minutes wheel connected thereto, and an hours sleeve adapted to receive an "hours" hand and having a toothed hours wheel connected thereto, wherein said improvement comprises;

a dual reduction gear assembly having a single shaft rotatably mounted in said stationary member, said assembly having a toothed third wheel meshing with and driven by said reduction drive pinion, a first reduction pinion meshing with and driving said hours wheel and a second reduction pinion meshing with and driving said minutes wheel, whereby said reduction drive pinion directly drives both the minutes wheel and the hours wheel through said dual reduction gear assembly.

2. The improvement according to claim 1, wherein said rotor pinion is a two-pin pinion and is caused to step once per second.

3. The improvement according to claim 1, wherein said reduction drive pinion and said first reduction pinion each are two-pin pinions.

4. The improvement according to claim 1, wherein said first reduction pinion is a two-pin pinion and wherein said second reduction pinion is a spur gear.

5. The improvement according to claim 1, wherein said stationary member is a plastic frame.

6. The improvement according to claim 1, wherein said rotor pinion, said reduction drive pinion and said first reduction pinion are two-pin pinions, and wherein said second reduction pinion is a spur gear.

* * * * *